US005802722A

United States Patent [19]

Maxey et al.

[11] Patent Number: 5,802,722

[45] Date of Patent: Sep. 8, 1998

[54] ONE HANDED KNIFE

[76] Inventors: Michael Maxey; Helga Maxey, both of 6623-39th Ave. SW, Seattle, Wash. 98136

[21] Appl. No.: 903,319

[22] Filed: Jul. 30, 1997

[51] Int. Cl.[6] ..... B26B 1/04

[52] U.S. Cl. ..... 30/160; 30/161

[58] Field of Search ..... 30/160, 161, 155, 30/331; 7/118–120; 81/177.4, 437–439, 490

[56] References Cited

U.S. PATENT DOCUMENTS

| | | | |
|---|---|---|---|
| 226,910 | 4/1880 | Friebertshauser | 30/161 |
| 749,320 | 1/1904 | Severance | 30/160 |
| 1,743,022 | 1/1930 | Carman | 30/161 |
| 4,837,932 | 6/1989 | Elsener . | |
| 4,974,323 | 12/1990 | Cassady | 30/160 X |
| 5,331,741 | 7/1994 | Taylor, Jr. . | |
| 5,400,509 | 3/1995 | Collins . | |
| 5,437,101 | 8/1995 | Collins . | |
| 5,502,895 | 4/1996 | Lamaier | 30/160 X |

*Primary Examiner*—Douglas D. Watts
*Attorney, Agent, or Firm*—Michael I. Kroll

[57] ABSTRACT

A one handed knife including a handle having upper and lower handle portions, the upper handle portion including an arcuate recess extending therethrough and the lower handle portion including a blade lock release extending therefrom. A blade is pivotally connected between the upper and lower handle portions and includes a thumb pin extending therefrom. A tension bar having a first and second ends is slideably connected at its first end to the upper handle portion and its second end extends through the arcuate recess and is connected to the blade. The one handed knife is movable between a first closed position in which the blade is partially positioned between the upper and lower handle portions, the thumb pin is positoned on a portion of the blade extending from between the upper and lower handle portions and the tension bar is in a first tensioned position at a first end of the arcuate recess and a second open position in which the blade extends from the handle, said tension bar is in a second untensioned position at a second end of the arcuate recess and the blade lock release is positioned to prevent the blade from pivoting towards the handle. The blade is caused to pivot from the first closed position into the second open position by application of a force on the thumb pin and away from the handle, the force being of a magnitude able to overcome the tension of the tension bar.

14 Claims, 6 Drawing Sheets

ONE HANDED KNIFE

BACKGROUND OF THE INVENTION

1. Field of the Invention

The present invention relates generally to knives and, more specifically, to a knife able to be pivoted between a first closed, secured position and a second open, extended position using one hand.

2. Description of the Prior Art

Numerous energy conversion devices have been provided in the prior art. For example, U.S. Pat. Nos. 4,837,932; 5,331,741; 5,400,509; and 5,437,101 all are illustrative of such prior art. While these units may be suitable for the particular purpose to which they address, they would not be as suitable for the purposes of the present invention as heretofore described.

U.S. Pat. No. 4,837,932

Inventor: Carl Elsener

Issued: Jun. 13, 1989

A pocket-knife having a blade which is pivotable between open and closed positions, and which is lockable in the open position, is disclosed. The pocket-knife comprises a handle, a knife blade pivotally mounted at one end of the handle, a beam spring extending substantially along the length of the handle, and a locking device for locking the knife blade in the open position. The beam spring is pivotally mounted for limited rocking movement within the handle. The beam spring includes a recess for receiving a retractable locking member of the locking device, a projection or ratchet tooth cooperating with the locking member, and cam guide cooperating with a tang portion of the knife blade to control the pivoting of the knife blade. When the knife blade is in its extended position, a spring urges the locking member into the recess of the beam spring. The projection on the beam spring abuts the locking member, thereby preventing the rocking movement of the beam spring and retraction of the blade until the locking member is removed from the recess.

U.S. Pat. No. 5,331,741

Inventor: William J. Taylor, Jr.

Issued: Jul. 26, 1994

A folding knife designed to be easily opened with one hand and having a thumb-actuated opening lever to pivot the blade from closed to opened positions. The thumb-actuated lever in a first preferred embodiment has an opening lever driving a sector gear that engages a drive gear for opening the blade. The opening lever remains within the plan-view outline of the knife body at all times. In another disclosed embodiment, the opening lever drives a cam which, in turn, causes a second lever to pivot within the body of the knife. Gear teeth on this second lever engage and rotate a blade drive gear, causing the blade to pivot between closed and opened positions. The opening lever in still another disclosed embodiment includes a thumb-operated slider having a cam surface engaging a follower to pivot a blade opening lever.

U.S. Pat. No. 5,400,509

Inventor: Walter W. Collins

Issued: Mar. 28, 1995

A folding knife having an elongated, unitary blade carrier which is received within a blade carrier cavity of a unitary molded handle. The metal construction of the blade carrier provides a rigid, hidden frame structure for strengthening the knife. The combination of the unitary handle and unitary blade carrier allow for simplified construction. Covers are also provided in the handle for concealing a blade pivot pin.

U.S. Pat. No. 5,437,101

Inventor: Walter W. Collins

Issued: Aug. 1, 1995

A folding knife having a blade and a longitudinally extending liner. Pivotally connected to the liner is a blade holder receiver, or shell, which receives the liner when the blade is in a retracted position, to cover and retain the blade within the liner. The liner is also received by the shell when the blade is in the extended position, and through cooperation of the shell with the blade and the liner, the blade can be locked in its extended position. The knife may be opened and closed using one hand, and a sharpening device is provided for attachment to the liner and shell for sharpening the blade.

SUMMARY OF THE PRESENT INVENTION

The present invention relates generally to knives and, more specifically, to a knife able to be pivoted between a first closed, secured position and a second open, extended position using one hand.

A primary object of the present invention is to provide a one handed knife that will overcome the shortcomings of prior art devices.

Another object of the present invention is to provide a one handed knife including a tension bar connected between a knife blade and a handle of the knife for moving the knife blade between the first closed position in which the knife blade is secured within the handle and the second open position in which the knife blade extends from the handle.

An additional object of the present invention is to provide a one handed knife wherein first and second ends of the tension bar extend through respective first and second recesses in the handle and connects at one of the first and second ends to the knife blade for limiting the range of movement of the tension bar and thus the knife blade.

A further object of the present invention is to provide a one handed knife which includes a thumb pin connected to the knife blade for moving the knife blade and tension bar from the first closed position into the second open position.

A yet further object of the present invention is to provide a one handed knife including a blade release connected to the handle for locking the knife blade in the second open position.

Another object of the present invention is to provide a one handed knife that is simple and easy to use.

A still further object of the present invention is to provide a one handed knife that is economical in cost to manufacture.

Additional objects of the present invention will appear as the description proceeds.

A one handed knife including a handle having upper and lower handle portions, the upper handle portion including an arcuate recess extending therethrough and the lower handle portion including a blade lock release extending therefrom. A blade is pivotally connected between the upper and lower handle portions and includes a thumb pin extending therefrom. A tension bar having a first and second ends is slideably connected at its first end to the upper handle portion and its second end extends through the arcuate recess and is connected to the blade. The one handed knife is movable between a first closed position in which the blade is partially positioned between the upper and lower handle portions, the thumb pin is positoned on a portion of the blade extending from between the upper and lower handle portions and the tension bar is in a first tensioned position at a first end of the arcuate recess and a second open position in which the blade extends from the handle, said tension bar is in a second untensioned position at a second end of the arcuate recess and the blade lock release is positioned to prevent the blade from pivoting towards the handle. The blade is caused to pivot from the first closed position into the second open position by application of a force on the thumb pin and away from the handle, the force being of a magnitude able to overcome the tension of the tension bar.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
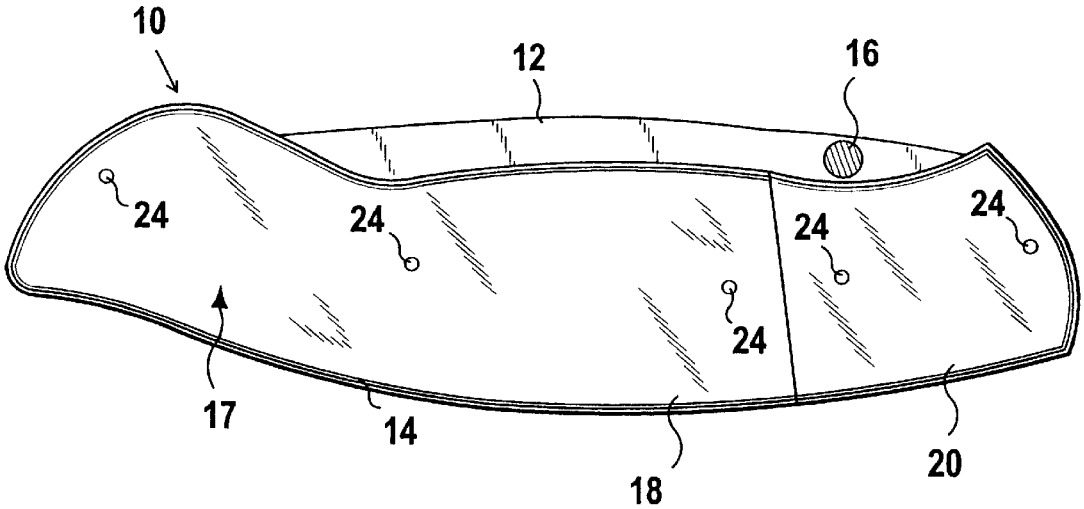
FIG. 1 is a perspective top view illustrating the one handed knife of the present invention.
Figure 2:
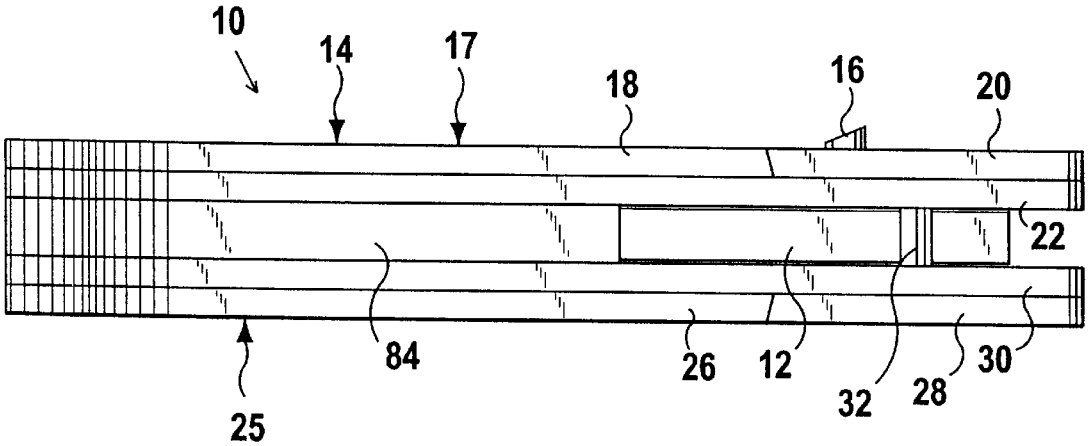
FIG. 2 is a side view of a first side of the one handed knife of the present invention.

Turning now descriptively to the drawings, in which similar reference characters denote similar elements throughout the several views, the Figures illustrate the one handed knife of the present invention. With regard to the reference numerals used, the following numbering is used throughout the various drawing figures.

10 one handed knife of the present invention

12 knife blade

14 handle

16 thumb pin

17 upper side of handle

18 lower portion of top side of handle

20 upper portion of top side of handle

22 upper internal plate

24 handle retaining screws

25 lower side of handle

26 lower portion of bottom side of handle

28 upper portion of bottom side of handle

30 lower internal plate

32 bushing

34 handle retaining screws

36 honed edge of blade

38 tension bar

40 arcuate recess in upper internal plate

42 sliding recess in upper internal plate

44 recess within lower portion of top side of handle

46 recess within upper portion of top side of handle

48 arrow indicating direction of applying pressure to thumb pin

50 arrow indicating force applied to tension bar

52 arrow indicating movement of the tension bar within arcuate recess

54 arrow indicating pivotal movement of the knife blade

56 arrow indicating movement of tension bar

58 holes within lower portion of top side of handle for receiving handle retaining screws

59 holes within upper portion of top side of handle for receiving handle retaining screws

60 holes within upper internal plate for receiving handle retaining screws

62 holes within lower portion of bottom side of handle for receiving handle retaining screws

63 holes within upper portion of bottom side of handle for receiving handle retaining screws

64 holes within lower internal plate for receiving handle retaining screws

66 retaining screws for securing upper internal plate

68 holes within upper internal plate for receiving retaining screws

70 retaining screws for securing lower internal plate

72 holes within lower internal plate for receiving retaining screws

73 recess in separator

74 lower screw for securing pivot pin

76 upper screw for securing pivot pin

78 hole within upper internal plate for receiving lower screw for securing blade retaining pin

80 hole within knife blade for receiving blade retaining pin

82 hole within lower internal plate for receiving upper screw for securing blade retaining pin

84 upper and lower handle portion separator

86 blade lock release

88 hole in knife blade for receiving tension bar

90 blade stop

92 lower screw for securing blade stop

94 upper screw for securing blade stop

96 hole in upper internal plate for receiving lower screw for securing blade stop

98 hole in lower internal plate for receiving upper screw for securing blade stop

DETAILED DESCRIPTION OF THE PREFERRED EMBODIMENT

Turning now descriptively to the drawings, in which similar reference characters denote similar elements throughout the several views, FIGS. 1 through 6 illustrate the one handed knife of the present invention indicated generally by the numeral 10.

The one handed knife 10 includes a knife blade 12 and a handle 14 for partially housing the knife blade 12 when the one handed knife 10 is in a closed position. The knife blade 12 partially extends from the handle 14 when in the closed position whereby a thumb pin 16 extends from a point on the knife blade 12 extending from the handle 14.

Figure 3:
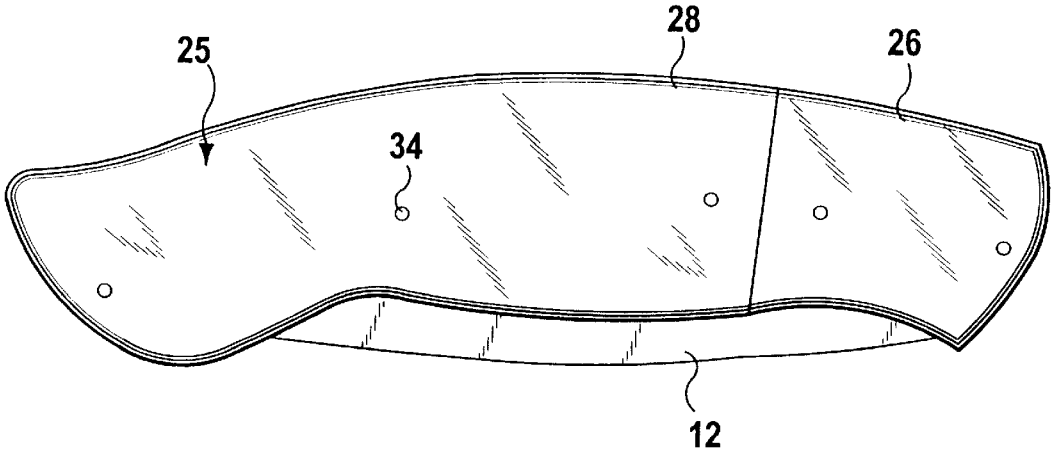
FIG. 3 is a perspective bottom view of the one handed knife of the present invention.
Figure 4:
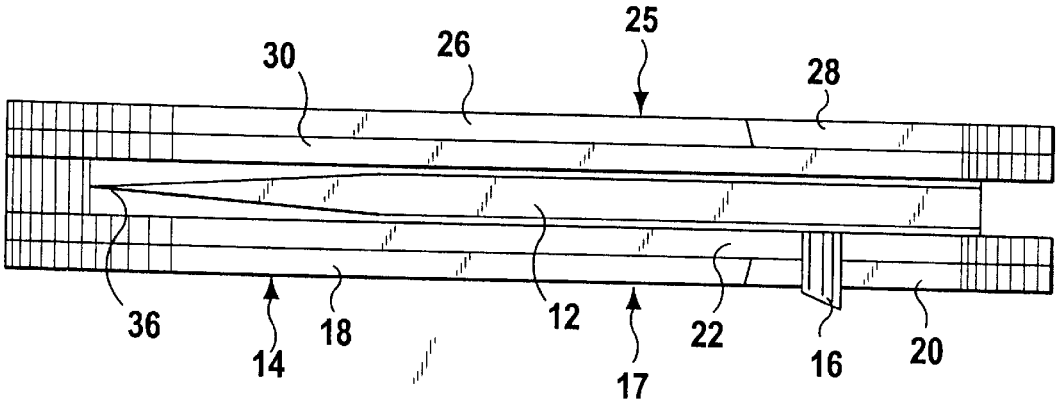
FIG. 4 is a side view of a second side opposing the first side of the one handed knife of the present invention.

The handle 14 includes an upper side 17 having a lower handle portion 18 and an upper handle portion 20 as is illustrated in FIG. 1. The upper and lower handle portions 18 and 20 are fastened to an upper internal plate 22 by handle retaining screws 24. The handle portion 14 further includes a lower side 25 having a lower handle portion 26 and an upper handle portion 28 as is illustrated in FIG. 3. The upper and lower handle portions 26 and 28 are fastened to a lower internal plate 30 by handle retaining screws 34. The knife blade 12 includes a honed edge 36 and is pivotally secured between the upper and lower internal plates 22 and 30 by a bushing 32 as is clearly illustrated by FIG. 2. In the closed secured position the honed edge 36 of the knife blade 12 is housed within the handle 14 between the upper and lower internal plates 22 and 30. A separator block 84 is positioned between the upper and lower internal plates 22 and 30 and receives the honed edge 36 of the knife blade 12 when in the closed position.

Figure 5:
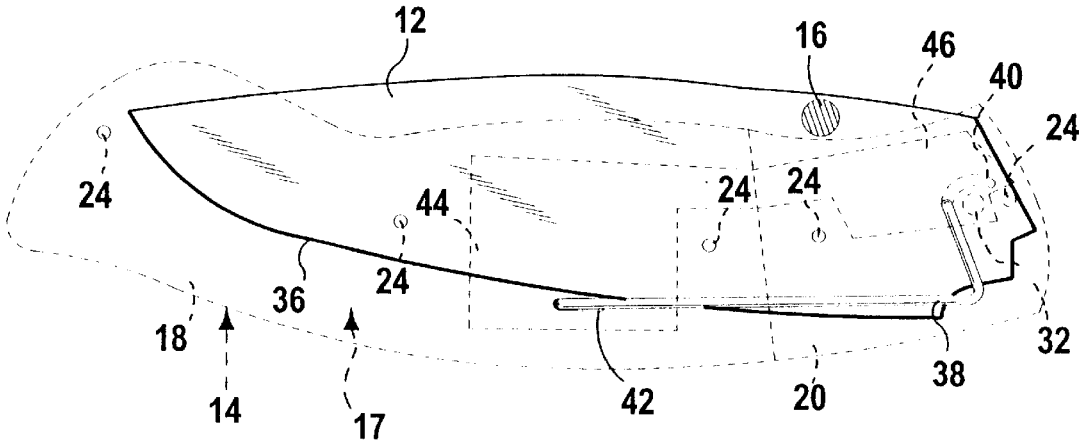
FIG. 5 is a perspective top view of the one handed knife of the present invention illustrating the handle in dashed lines.
Figure 5A:
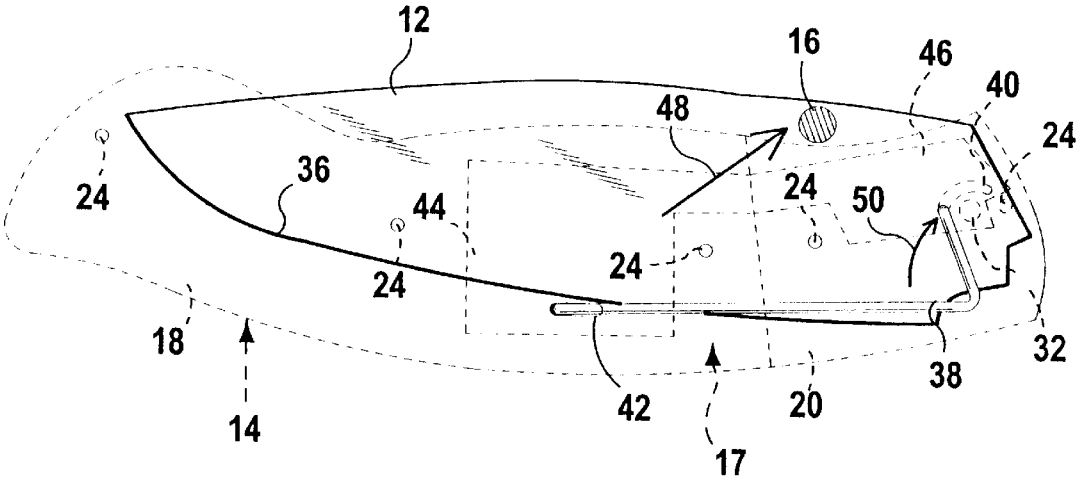
FIG. 5A is a perspective top view of the one handed knife of the present invention illustrating the handle in dashed lines and the direction of pressure to be applied to the thumb pin to place the knife in the open position.
Figure 5B:
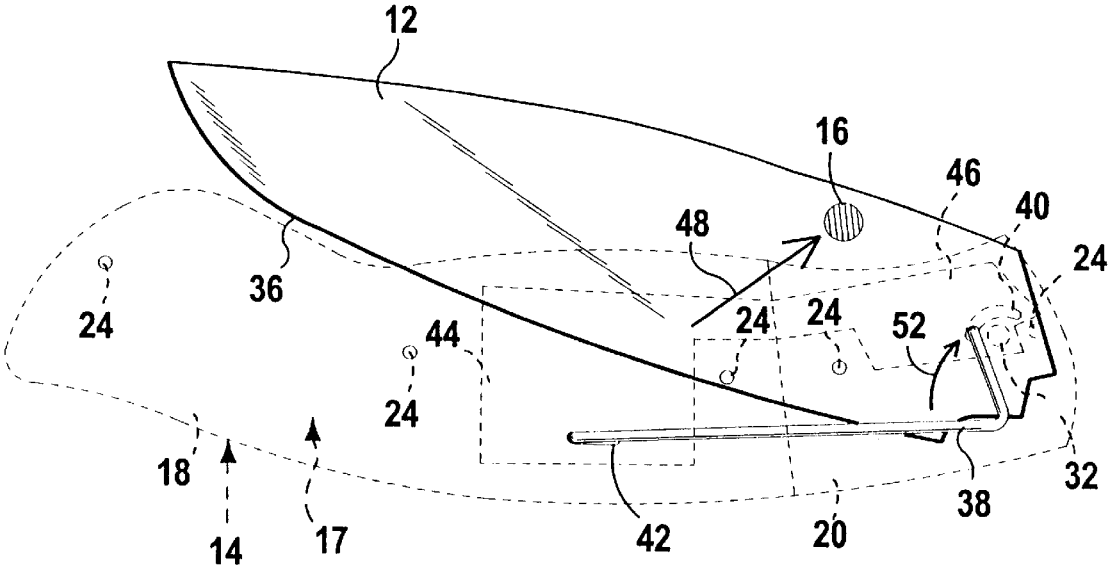
FIG. 5B is a perspective top view of the one handed knife of the present invention illustrating the handle in dashed lines and the direction of pressure to be applied to the thumb pin and movement of the tension bar to place the knife in the open position.
Figure 5C:
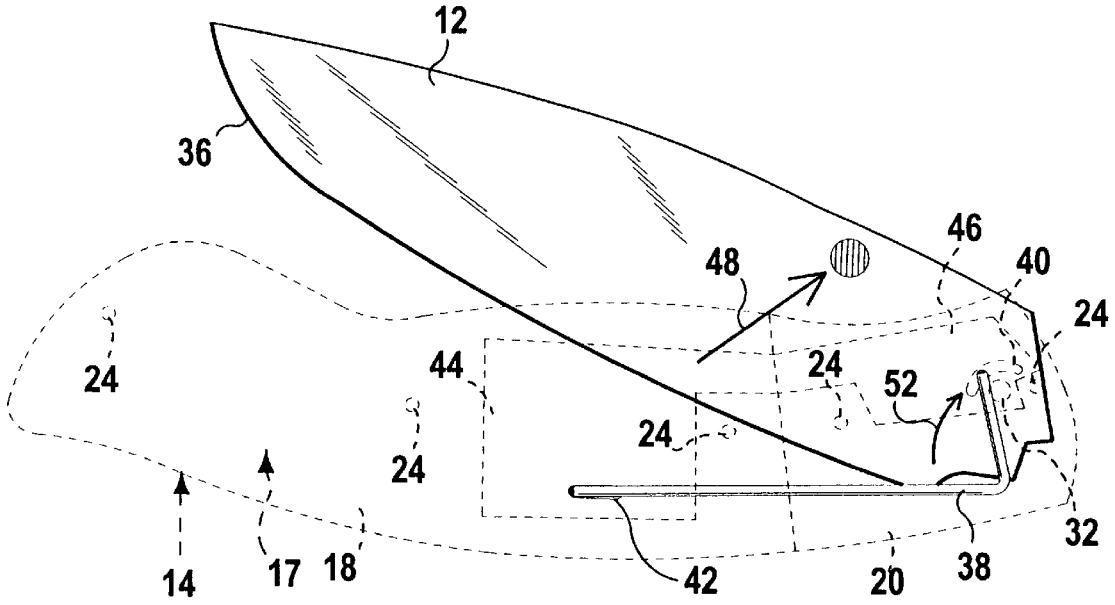
FIG. 5C is a perspective top view of the one handed knife of the present invention illustrating the handle in dashed lines and the decreasing direction of pressure to be applied to the thumb pin and movement of the tension bar placing the knife in the open position.
Figure 5D:
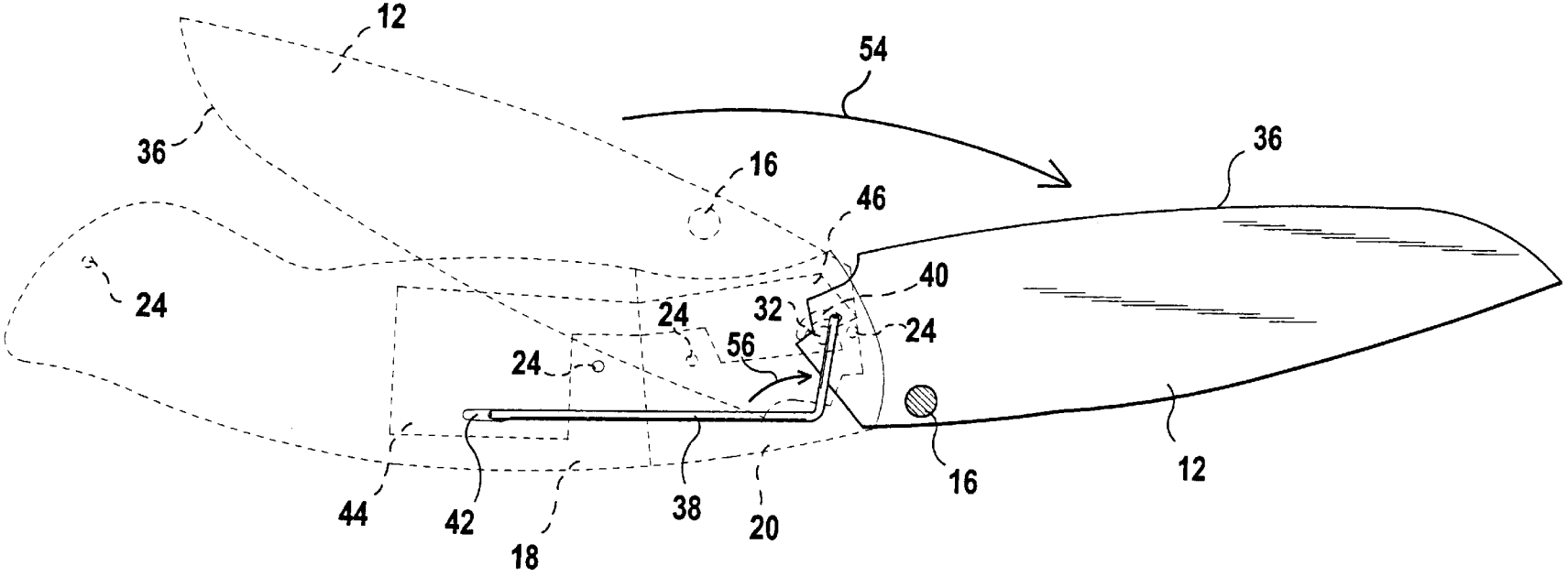
FIG. 5D is a perspective top view of the one handed knife of the present invention illustrating the handle in dashed lines and the knife in the open position.

The upper internal plate 22 includes a first arcuate recess 40 and a second sliding recess 42 separated therefrom along a portion of the length of the upper internal plate 22. A tension bar 38 is positioned between the first arcuate recess 40 and the second sliding recess 42 extending through each. The tension bar 38 also connects with the knife blade 12 at a position aligned with the first arcuate recess 40. When pressure is applied in the direction of the arrow 48 to the thumb pin 16 a pressure is exerted on the tension bar 38 in the direction of arrow 50 illustrated in FIG. 5A. The continued pressure applied to the thumb pin 16 in the direction of arrow 48 causes the tension bar 38 to overcome an opposing force or tension applied by the walls of the arcuate recess 40 and begin to move along a path defined by the arcuate recess 40. As the tension bar 38 moves within the arcuate recess 40 it carries the knife blade 12 with it causing the knife blade 12 to be removed from its position between the upper and lower internal plates 22 and 30 and within the handle 14 as is depicted in FIGS. 5B and 5C As one end of the tension bar 38 moves along the arcuate recess 40 the opposite end of the tension bar 38 is caused to slide within the sliding recess 42 towards the arcuate recess 40. FIG. 5D illustrates the knife blade in its extended open position. The arrow 54 illustrates the motion of the knife blade 12 as it is moved from the closed position to the open position. The arrow 55 illustrates the full movement of the tension bar 38 from the closed position to the open position. It is evident from FIG. 5D that the tension bar 38 has also moved along the sliding recess 42 to be positioned in the opposite end of the sliding recess 42 when the knife blade 12 is in the open position.

Figure 6:
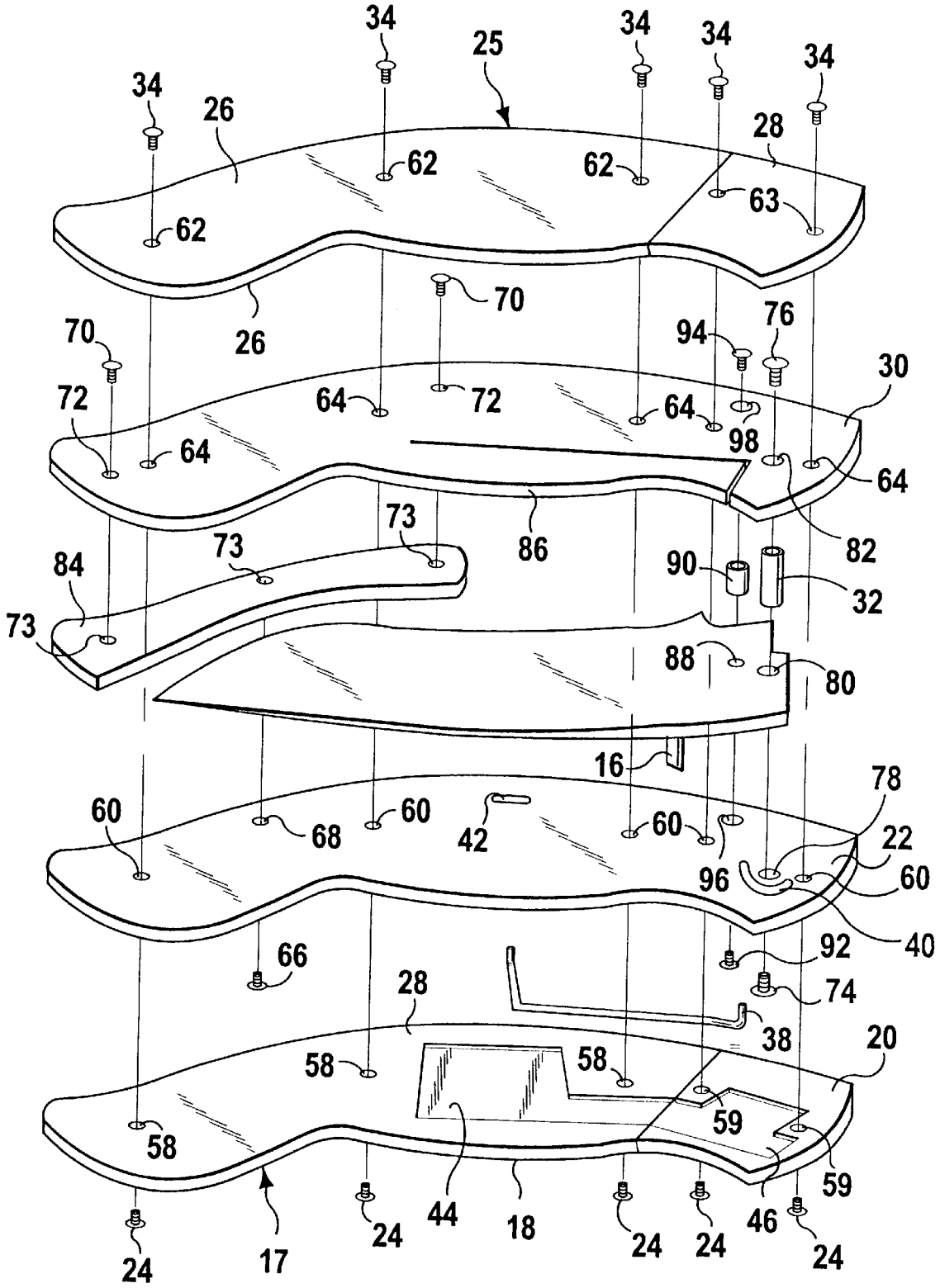
FIG. 6 is an exploded view of the one handed knife of the present invention.

FIG. 6 illustrates an exploded view of the one handed knife 10 and clearly shows all the elements which form the knife 10. As can be seen from this figure the upper and lower portions 18 and 20 of the upper side 17 of the handle 14 each include recesses 58 and 59 respectively therein and the upper internal plate 22 includes recesses 60 therein. The recesses 58 and 59 are aligned with the recesses 60 to receive the handle retaining screws 24 for connecting the lower and upper portions 18 and 20 of the top side 17 of the handle 14 to the upper internal plate 22. The upper and lower portions 26 and 28 of the lower side 25 of the handle 14 each include recesses 62 and 63 respectively therein and the lower internal plate 30 includes recesses 64 therein. The recesses 62 and 63 are aligned with the recesses 64 to receive the handle retaining screws 34 for connecting the lower and upper portions 26 and 28 of the lower side 25 of the handle 14 to the lower internal plate 30.

The lower portion 18 of the top side 17 of the handle 14 includes a recess 44 on a side mating with the upper internal plate 22 for receiving a portion of the tension bar 38 therein for allowing movement of the tension bar 38 when the one handed knife 10 is moved between the closed and opened positions. The upper portion 20 of the top side 17 of the handle 14 also includes a recess 46 on a side mating with the upper internal plate 22 for receiving the tension bar 38 therein for allowing movement of the tension bar 38 when the one handed knife 10 is moved between the closed and opened positions.

The upper internal plate 22 further includes recesses 68, the lower internal plate 30 includes recesses 72 and the separator 84 includes recesses 73. These recesses 68, 72 and 73 are aligned to receive retaining screws 66 and 70 as illustrated to connect the upper and lower internal plates 22 and 30 to both the separator 84 and each other.

The bushing 32 is positioned within a recess 80 extending through the knife blade 12 and is aligned with identical recesses 78 and 82 in the upper and lower internal plates 22 and 30 respectively. First and second separator retaining screws 74 and 76 extend through the upper and lower internal plates 22 and 30 respectively and are threaded within the bushing 32 for pivotally connecting the knife blade therebetween.

A blade lock release 86 is formed within the lower internal plate 30. The blade lock release 86 retains and holds the knife blade 12 in its open position thereby holding the knife blade 12 in a stationary position preventing it from moving while being used. The blade lock release 86 is cut from the lower internal plate 30 and biased towards the upper internal plate 22 to move behind the knife blade 12 when the blade is in the open position and thereby preventing the knife blade 12 from pivoting back towards the handle 14 and into the closed position. The knife blade 12 is released from its open position by applying pressure to the blade lock release 86 in a direction away from the upper internal plate 22 and towards the lower internal plate 30 thereby removing the blade lock release 86 from behind the knife blade 12. This allows the knife blade 12 to be pivoted towards the handle 14 and into the closed position. The knife blade 12 includes an additional recess 88 for receiving an end of the tension bar 38 extending through the arcuate recess 40 thus allowing the force of the tension bar 38 to cause the knife blade 12 to pivot therewith when pressure is applied to the thumb pin 16.

A blade stop 90 is positioned between the upper and lower internal plates 22 and 30 and acts to stop the pivoting motion of the knife blade 12 when pivoted towards the handle 14 and into the closed position. The upper and lower internal plates 22 and 30 each further include a recess 96 and 98, respectively, for receiving a blade stop retaining screw 92 and 94. The blade stop retaining screws 92 and 94 each extend through a respective one of the recesses 96 and 98 and engage the blade stop 90 and thereby hold it in position to stop the pivoting movement of the knife blade 12.

The operation of the one handed knife will now be described with reference to the figures. In operation, the one handed knife 10 is originally positioned in its closed position. In this position the honed edge 36 of the knife blade 12 is received between the upper and lower internal plates 22 and 30, respectively, and the thumb pin 16 extends from a portion of the knife blade 12 not housed within the handle 14. The blade stop 90 prevents the knife blade 12 from extending further into the handle 14 and the honed edge 36 of the knife blade 12 is received by the separator 84.

When a pressure is applied to the thumb pin 16 in a direction illustrated by the arrow 48 away from the handle 14, a force is applied to the tension bar 38. When the force applied to the thumb pin 16 causes the associated force applied to the tension bar 38 to overcome the opposing force or tension of the tension bar 38 as applied by the walls of the arcuate recess 40, the knife blade 12 will be caused to pivot away from the handle 14 as the tension bar 38 moves along the arcuate recess 40. The movement of the tension bar 38 and the knife blade 12 is depicted by the arrows 52, 54 and 56 in FIGS. 5B, 5C and 5D. The movement of the tension bar 38 is bounded by the arcuate recess 40, the sliding recess 42, the recess 44 within the lower portion 18 of the handle 14 and the recess 46 within the upper portion 20 of the handle 14. Once the knife blade 12 is pivoted into its fully extended open position the blade lock release 86 is allowed to fall in behind the knife blade 12 due to its angular bias away from the lower internal plate 30. This prevents the knife blade from pivoting and holds it firmly in place. It is now possible to safely use the one handed knife 10 without the possibility of the knife blade 12 pivoting and closing during use and thus injuring the user.

When the use of the one handed knife is completed and it is desired to return the knife blade 12 to its closed position, the user will apply a force to the blade lock release 86 towards the lower internal plate 30 and thus away from its position behind the knife blade 12. The knife blade 12 can now be easily pivoted towards the handle 14 and into the closed position. As the knife blade 12 is pivoted in this direction the tension bar 38 is caused to pivot with the knife blade 12 and traverse the arcuate recess 40 back to its original position. The opposite end of the tension bar 38 also slides within the sliding recess 42 to its original positon. The pivoting of the knife blade 12 is ceased when it contacts the blade stop 90 and the honed edge of the knife blade 36 is received by the separator 84. In this position the tension bar 38 is "reset" and a pressure must again be applied to the thumb pin 16 to overcome its tension force and cause the knife blade 12 to pivot into the open position as described hereinabove. The one handed knife 10 is thus securely closed and the knife blade cannot be pivoted out of this closed position without conscious application of a force to the thumb pin 16.

From the above description it can be seen that the one handed knife of the present invention is able to overcome the shortcomings of prior art devices by providing a one handed knife which includes a tension bar connected between a knife blade and a handle of the knife for moving the knife blade between the first closed position in which the knife blade is secured within the handle and the second open position in which the knife blade extends from the handle, the tension bar extending through first and second recesses in the housing for limiting the movement of the tension bar and thus the knife blade. The one handed knife also includes a thumb pin connected to the knife blade for moving the knife blade and tension bar from the first closed position into the second open position and a blade release connected to the housing for locking the knife blade in the second open position. Furthermore, the one handed knife of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by letters patent is set forth in the appended claims:

1. A one handed knife comprising:

a) a handle including first and second handle portions, said first handle portion including an arcuate recess extending therethrough and said second handle portion including a blade lock release extending therefrom;

b) a blade pivotally connected between said first and second handle portions, said blade including a thumb pin extending therefrom; and c) a tension bar having a first end slideably connected to said first handle portion and a second end extending through said arcuate recess and connected to said blade, wherein said one handed knife is movable between a first closed position in which said blade is partially positioned between said first and second handle portions, said thumb pin is positoned on a portion of said blade extending from between said first and second handle portions and said tension bar is in a first tensioned position at a first end of said arcuate recess and a second open position in which said blade extends from said handle, said tension bar is positioned at a second end of said arcuate recess and said blade lock release is positioned to prevent said blade from pivoting towards said handle, said blade being caused to pivot from said first closed position into said second open position by application of a force on said thumb pin away from said handle, said force being of a magnitude able to overcome said tension of said tension bar.

2. The one handed knife as recited in claim 1, further comprising a blade stop connected between said first and second handle portions for limiting the pivoting movement of said blade.

3. The one handed knife as recited in claim 2, wherein said blade has a honed edge and said knife further comprises a separator positioned between said first and second handle portions for receiving said honed edge when said knife is in said first closed position.

4. The one handed knife as recited in claim 1, wherein said blade lock release is biased to extend towards said first handle portion, wherein a force is applied by said blade on said blade lock release towards said second handle portion in said first closed position and said blade lock release extends behind said blade preventing pivoting of said blade in said second open position.

5. The one handed knife as recited in claim 1, further comprising a bushing having an axis and connected between said first and second handle portions and extending through said blade, wherein said blade is povotable about said axis of said bushing.

6. The one handed knife as recited in claim 1, wherein said first and second handle portions each include an internal plate and upper and lower outer portions connected to said internal plate on a side opposite said blade.

7. The one handed knife as recited in claim 6, wherein said arcuate recess extends through said internal plate of said first handle portion and said tension bar is positioned on a side of said internal plate of said upper handle portion opposite said blade.

8. The one handed knife as recited in claim 7, wherein said upper and lower outer portions of both said first and second handle are each positioned on a side of said respective inner plate opposite said blade.

9. The one handed knife as recited in claim 8, wherein said upper and lower outer portions of said first handle portion each include a recess for receiving said tension bar.

10. The one handed knife as recited in claim 9, wherein said tension bar includes a second end and said internal plate of said first handle portion includes a sliding recess, wherein said second end of said tension bar is slideably positioned within said sliding recess.

11. The one handed knife as recited in claim 10, wherein said blade further includes a recess for receiving the end of said tension bar extending through said arcuate recess.

12. The one handed knife as recited in claim 1, wherein said thumb pin extends toward said first handle portion.

13. The one handed knife as recited in claim 12, further comprising first means for connecting said upper and lower outer portions of said first handle portion to said internal plate of said first handle portion and second means for connecting said upper and lower outer portions of said second handle portion to said internal plate of said second handle portion.

14. The one handed knife as recited in claim 13, wherein said first means for connecting includes first recesses extending through both said upper and lower outer portions of said first handle portion and second recesses extending through said internal plate of said first handle portion aligned with said first recesses and a plurality of first handle retaining screws extending through said first and second recesses and said second means for connecting includes third recesses extending through both said upper and lower outer portions of said second handle portion and fourth recesses extending through said internal plate of said second handle portion aligned with said third recesses and a plurality of second handle retaining screws extending through said third and fourth recesses.

* * * * *